United States Patent [19]

Yamashita et al.

[11] 4,288,515

[45] Sep. 8, 1981

[54] PROCESS FOR REVERSAL DEVELOPMENT USING INDUCTIVELY CHARGEABLE MAGNETIC POWDERY DEVELOPER

[75] Inventors: Keitaro Yamashita; Kohji Noguchi, both of Saitama, Japan

[73] Assignee: Hitachi Metals, Ltd., Tokyo, Japan

[21] Appl. No.: 919,999

[22] Filed: Jun. 28, 1978

[30] Foreign Application Priority Data

Jul. 6, 1977 [JP] Japan ..... 52-79925

[51] Int. Cl.[3] ..... G03G 13/09; G03G 13/22

[52] U.S. Cl. ..... 430/100; 430/122; 118/657; 118/658

[58] Field of Search ..... 96/1.3, 1 R; 427/18, 427/19, 20; 430/122, 100; 118/657, 658

[56] References Cited

U.S. PATENT DOCUMENTS

| | | | |
|---|---|---|---|
| 2,817,765 | 12/1957 | Hayford et al. | 96/1.3 |
| 2,911,330 | 11/1959 | Clark | 96/1 R |
| 2,914,403 | 11/1959 | Sugarman | 96/1.3 |
| 3,816,840 | 6/1974 | Kotz | 96/1.4 |
| 3,888,666 | 6/1975 | Matsumoto | 96/1 R |
| 3,909,258 | 9/1975 | Kotz | 96/1 R |

FOREIGN PATENT DOCUMENTS

| | | | |
|---|---|---|---|
| 2219005 | 12/1972 | Fed. Rep. of Germany | 96/1 R |

*Primary Examiner*—Richard L. Schilling
*Assistant Examiner*—John L. Goodrow
*Attorney, Agent, or Firm*—Finnegan, Henderson, Farabow, Garrett & Dunner

[57] ABSTRACT

A reversal developing process carried out preferably with an inductively chargeable magnetic powdery developer. An electrostatic latent image having first charged areas and second lesser charged areas formed on a photoreceptor or a photoconductor is developed negatively by forming a toner brush of single component, i.e., inductively chargeable, magnetic powdery developer on a shell incorporating a permanent magnet to adhere the developer on the first charged areas, charging uniformly the developed photoreceptor with the same polarity as the first charged area and further rubbing the surface of the photoreceptor with a second toner brush to remove the previously adhered developer from the surface and to adhere powdery developer onto the second lesser charged areas. The apparatus includes two applicators for powdery developer positioned along the path of movement of the latent image with a D.C. charger stationed between the applicators. In the preferred embodiment, the two applicators and charger are incorporated in a single device.

4 Claims, 4 Drawing Figures

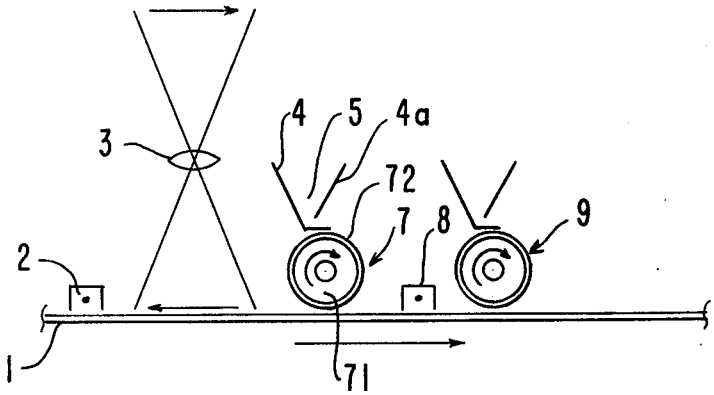
FIG. 1
FIG. 2a
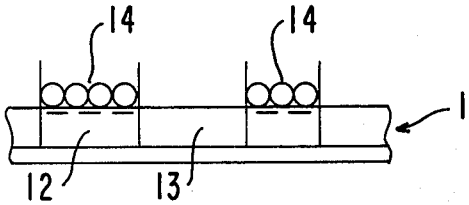
FIG. 2b
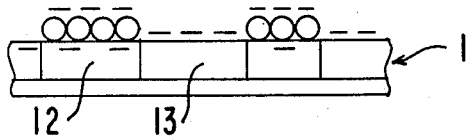
FIG. 2c
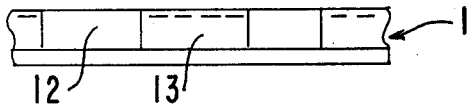
FIG. 2d
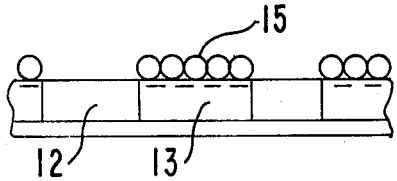

PROCESS FOR REVERSAL DEVELOPMENT USING INDUCTIVELY CHARGEABLE MAGNETIC POWDERY DEVELOPER

BACKGROUND OF THE INVENTION

The present invention relates to a process of reversal development of an electrostatic latent image by adhering powdery developer on the portions of the latent image having the lesser electrostatic charge, and more particularly to a process of reversal development using a single component, i.e., inductively chargeable, magnetic toner and an apparatus for carrying out the process.

In an electrostatic developing system, an electrostatic latent image is ordinarily pictured on a support member of a photoconductor. The latent image is produced by the steps of charging positively or negatively the photoconductor, such as non-crystalline selenium or the like, in a uniform manner, exposing a light image to be reproduced on the uniformly charged photoconductor, thus reducing the charge on the exposed portion and maintaining the charge on the non-exposed portion substantially as such. Alternatively, it has also been conventional to produce an electrostatic image by loading a charge on a highly resistant sheet, such as an electrostatic recorder sheet.

In the development of the latent image, the term "normal development" refers to a process wherein colored powder, which is called a toner, adheres to the higher potential portions corresponding to the unexposed portions in the electrostatic latent image produced in such a manner, the difference in potential being an absolute value. On the other hand, the term "reversal development" refers to a process in which the toner adheres to the lesser potential portions, the lesser charged portions corresponding to the exposed portions.

Recently there has been an increased demand for reversal development to be used, for example, in microfilm printers, facsimiles and laser beam printers. In a process of a development of prints by microfilm printers, the latent image is developed with toner which is formed on a photoconductive paper with exposure to a light pattern through a negative film. As the negative film has transparent characters on opaque background, the latent image formed on the paper comprises discharged areas corresponding to the characters and charged areas corresponding to the background. Upon the development of the latent image, it is necessary to adhere powdery developer to the discharged areas in order to obtain a positive visible image. And also, in some cases of development of facsimiles and laser beam printers, it is well-known that powdery developer should adhere on discharged areas on a member supporting the electrostatic latent image.

Such a reversal development in the prior art was shown in U.S. Pat. No. 3,888,666 to Matsumoto et al. The patent disclosed that a photoconductor can be used as an electrode facing the photoconductor having a latent image. The photoconductor, used as an electrode, is the same material as that of the photoconductor for the latent image and has the same charge as that originally charged on the photoconductor for the latent image. The latent image is negatively developed by supplying a developer powder dispersed in an insulating liquid which is charged beforehand in the same polarity as the latent image.

On the other hand, there has been recently developed a process for normal developing with a toner containing magnetic particles therein in place of conventional developer, such as liquid developers and two component developers which comprise colored powder and carrier. The newly developed toner, so-called single component magnetic toner, which is inductively chargeable, has proved popular because it does not need mixing of conventional colored powder and carrier particles. It results in reducing the prior complicated structures of the developing apparatus.

Representatively, such a process for normal development is disclosed in U.S. Pat. Nos. 3,909,258 and 3,816,840 both to Arthur R. Kotz. In this process, toner particles are used exclusively for the development without the use of carrier particles. The toner particles, which contain ferromagnetic particles, are conveyed to the developing position, during absorption onto an electroconductive shell incorporating a permanent magnet, to form a magnetic brush at least at the developing position. Electrically conductive circuits are formed between the toner particles and the electroconductive shell and the electroconductive shell is grounded to the frame of the duplicator so that an electric charge having an opposite polarity is induced on the toner brush by the action of the electric field caused by the electrostatic charge on the support member for the electrostatic latent image. In other words, as the toner on the magnetic brush is grounded, a positive charge is induced on the toner where the latent image on the support member bears a negative charge. However, it is very difficult to obtain a reversal development in which the inductively chargeable toner adheres to the lesser charged areas of the electrostatic image. Since the so-called single component toner is inductively charged by an external electrical field, the toner tends to adhere to the more highly charged areas, rather than to the lesser charged areas of the image.

SUMMARY OF THE INVENTION

It is therefore an object of this invention to provide a reversal developing process with an inductively chargeable magnetic toner.

It is another object of this invention to provide a reversal developing process in which a triboelectric developer may be used.

It is a further object of this invention to provide a developing apparatus suitable for the reversal developing process, using an inductively chargeable magnetic toner.

According to the present invention, the objects are accomplished by a developing process comprising the steps of, charging uniformly a normally developed electrostatic image on a photoreceptor with the same polarity as the former more highly charged areas and redeveloping the photoreceptor with a powdery developer to obtain a reverse development.

As known in the art, the electrostatic latent image is formed on a photoreceptor, such as a photoconductor including a non-crystalline selenium layer deposited on an aluminum substrate, a zinc oxide-coated sheet and the like, by, for example, charging uniformly the surface of the photoreceptor and exposing the surface to a light pattern of an original to be reproduced. The latent image comprises first higher charged areas corresponding to dark portions of the original and second lesser charged areas corresponding to light portions of the original. In other cases, the latent image may be formed on a high resistance sheet by exposing a uniformly charged photoreceptor to a light beam scanning on it and transferring the charge to the high resistance sheet.

The process of the invention for developing the latent image includes the steps of: supplying first powdery developer over the surface subject to the electrostatic force of the charged areas for adhering a layer of the first developer primarily to the first charged areas; charging the developer layer adhering to the first areas and recharging the second areas both with a uniform amount of charge of the same polarity as the potential of the first areas; removing the previously adhered developer from the surface; and providing second powdery developer over the surface subject to the electrostatic force of the charged areas for adhering the second developer to the second charged areas.

In the preferred embodiment, the step of supplying the first powdery developer includes the steps of forming a first toner brush with ferromagnetic toner on a first shell by a magnetostatic attraction force and subjecting the first toner brush to the electrostatic force of the charged areas for adhering the toner as a layer on the first charged areas of the surface; the step of charging includes the steps of charging the toner layer adhering to the first areas and recharging the second areas both with a uniform amount of charge of the same polarity as the potential of the first areas; and the step of providing second powdery developer includes the steps of forming a second toner brush with ferromagnetic toner on a second shell by a magnetostatic attraction force and interpositioning the second toner brush and the surface for subjecting the second toner brush to the electrostatic force of the toner layer on the first charged areas and the electrostatic force of the second charged areas for removing the previously adhered toner and adhering toner on the second recharged areas.

The invention includes adhering a toner layer by a first toner brush according to the charge amount of the latent image on the surface, charging both the toner layer and non-toner areas by a uniform amount of charge of the same polarity as the potential of the latent image, and subjecting a second toner brush to the electrostatic force of the charge on the surface to remove previously adhered toner from the surface and to adhere toner in the second toner brush to the surface according to the charge amount on the surface.

It is preferred that the ferromagnetic toner be inductively chargeable and that the toner brushes contact the surface in subjecting the brushes to the electrostatic forces of the latent image.

According to the invention, the developing apparatus includes means for advancing the image-carrying surface along a path of movement, applicator means for supplying powdery developer, subject to the electrostatic force of the latent image, at two discrete positions along the path of movement of the advancing surface, and D.C. charging means aligned with the path of movement between the two discrete positions for applying charge to the surface.

In the preferred embodiment, the means for advancing the image-carrying surface includes a rotatable drum and the applicator means for supplying powdery developer includes a toner tank, two magnetic roller applicators in the tank and radially juxtaposed to the drum, the D.C. charger being between the two applicators and magnetic roller for stirring toner in the toner tank.

BRIEF DESCRIPTION OF THE DRAWINGS

FIG. 1 is a schematic sectional view showing a first apparatus for performing the process of the present invention.

FIGS. 2(*a*), (*b*), (*c*) and (*d*) show the developing steps according to the present invention.

DETAILED DESCRIPTION OF THE PREFERRED EMBODIMENTS

Figure 3:
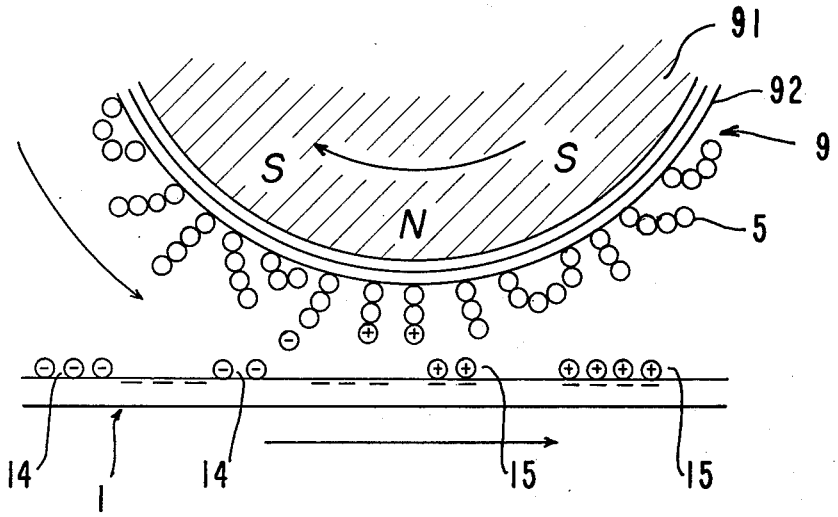
FIG. 3 is a schematic sectional view of a toner brush utilized in the steps shown in FIGS. 2(*c*) and (*d*).

Referring to FIGS. 1 and 2, the present invention will be now described. An electrostatic latent image is conventionally formed on a photoreceptor 1 which, for example, may be an electroconductive base layer and a photoconductive top layer. The surface of the photoconductive layer is electrostatically uniformly charged, running to the right as shown in FIG. 1, through a corona charger 2, and is exposed to a light pattern of an original, to be reproduced, through an optical system 3. By such a known means, the surface has an electrostatic latent image having first higher charged areas corresponding to dark portions of the original and second lesser charged areas corresponding to light portions of the original, which schematically coincide with portions 12 and 13, respectively.

In accordance with the invention, the development of the latent image includes supplying first powdery developer over the surface subject to the electrostatic force of the charged areas for adhering a layer of first developer primarily to the first charged areas.

As embodied here, as shown in FIG. 1, the step of supplying the first powdery developer includes applying powdery developer by a magnetic roll applicator 7. The powdery developer may be applied, however, by other known means such as a cascade process.

As the powdery developer, not only a magnetic toner but also a developer mixture of non-magnetic toner and carrier particles may be used in this step of the process. The powdery developer stored in a toner tank 4 is applied on the surface of the photoreceptor 1 to adhere to the first higher charged areas 12 but not to the second lesser charged areas 13. Accordingly, as shown in FIG. 2(*a*), a toner layer 14 is formed on the first charged areas, corresponding to the charge potential of the areas.

In accordance with the invention, the development process continues by charging the developer layer adhering to the first areas and the second areas both with a uniform amount of charge of the same polarity as the potential of the first areas.

As embodied herein, the whole surface of the photoconductor, both as to the toner image and the lesser charged areas, is electrostatically charged uniformly by a charger.

The second areas 13 of the photoconductor are thus charged by the uniform charge bias, as well as the toner layer 14 as shown in FIG. 2(*b*).

Although the above explanation and FIGS. 2(*b*) to (*d*) are described as if each of the first and the second areas has uniform potential and also as if the resultant potential by the recharging has uniform charge potential, that is only for convenience of explanation and it should be understood that the density of the toner layer will vary depending on the primary charge on the first areas and that the resultant potential of the recharging depends on the amount of the adhered developer on the first areas and the primary charge amount on the second areas.

When the original includes half-tone, the charge on the half-tone areas will be intermediate the charge on the first higher charged areas and the second lesser charged areas. The powdery developer will adhere to the intermediate areas in proportion to the charge on them and the charge on the reversed latent image will be inversely proportional to the amounts of the originally adhered developer.

As the first areas 12 are shielded electrostatically by the toner layer 14 during the recharging they could be charged inversely proportionally to the amount of the toner layer by the second charging. The original electrostatic charge on the first areas is gradually damped by dark decay and by neutralization by the toner layer. The process of the invention then includes removing the previously adhered developer from the surface.

After removing the toner layer 14 as shown in FIG. 2(*c*), the reverse latent image is obtained. The latent image is then the reverse of the original one.

In accordance with the broad concept of the invention the developing process is completed by providing second powdery developer over the surface subject to the electrostatic force of the charged areas for adhering the second powdery developer to the second charged areas.

The reversed latent image is developed by applying powdery developer 15 to adhere mainly on the second areas 13 by a second applicator 9. The reverse toner image on the photoreceptor may be fixed by appropriate process, such as pressure fixing, heat fixing and heat-pressure fixing, depending upon the ingredients contained in the developer or toner. The toner image may be, if desired, transferred to a suitable sheet and then fixed.

In accordance with a preferred embodiment of the invention, the first step of the process includes forming a first toner brush with ferromagnetic toner on a first shell by a magnetostatic attraction force.

According to the invention, an inductively chargeable toner is preferably used as the powdery developer. The inductively chargeable magnetic toner may be stored, for example, in a toner tank 4 of a hopper type and fed onto a non-magnetic cylindrical shell 72 by the action of a magnetic field due to a permanent magnet 71 disposed within the shell 72. The toner is then conveyed to a position in the vicinity of the photoconductor 1, according to the rotation of the shell 72 or the permanent magnet 71.

The toner 5 forms a toner brush on the shell 72 by the magnetic flux lines developed by the magnet 71. When the photoconductor 1 is driven from left to right, as shown in FIG. 1, the toner brush on the shell approaches the latent image on the photoconductor while moving in the same direction and the tip portion of the toner brush is exposed to the electrical field of the latent image and is inductively charged to the opposite polarity of the latent image. When the tip of the toner brush approaches the position over the surface subject to an electrostatic force from the charge of the latent image, the inductively charged toner mainly adheres to the first higher charged portions, proportionally to the charge amount on the surface of the photoconductor 1.

The inductively chargeable toner not only has the advantage of not having to be precharged, but also the advantage that the steps for removing the toner as in FIG. 2(*c*) and for developing as in FIG. 2(*d*) may be carried out consecutively in the same operation.

As shown in FIG. 3, cylindrical permanent magnet 91 is arranged so that elongated magnetic poles extend in the axial direction on the periphery of the cylinder. A magnetic roll 9 comprises the cylindrical magnet 91 and the non-magnetic shell 92 in which the shell rotates relatively to cylindrical magnet 91. The shell 92 is arranged in the vicinity of photoconductor 1 so that, as the cylindrical magnet 91 rotates, the inductively chargeable magnetic toner 5 adheres on the non-magnetic shell 92 to be conveyed to the photoconductor 1. The toner 5 forms a magnetic brush on the shell 92 corresponding to the flux lines of the inner magnet 91. When the tips of the magnetic brush approach toner layer 14, having a negative charge, for example, the tips of the toner brush on the shell 92 develop positive charges to generate electrostatic attraction between the toner layer 14 and the toner brush.

However, as stated above, the first higher charged areas 12 on the photoconductor substantially lose their charge by decay so that the attraction between the toner layer 14 and the toner brush becomes larger than that between the first areas and the toner layer. In addition, the magnetic attraction acts on the inductively chargeable magnetic toner due to the second magnetic roll 9 so that toner layer 14 is separated from the photoconductor to adhere on the magnetic roll.

By this process, the toner is removed from the first charged areas and they are left substantially without charge. On the other hand, the second areas 13, charged by the charger 8, are developed in a manner similar to the first development as mentioned above. Namely, the tips of the magnetic brush of the inductively chargeable magnetic toner 5 on the magnetic roll 9 are inductively charged to the inverse polarity to the charge on the second areas 13. When the tips of the magnetic brush approach the second areas 13, the electrostatic attraction between the charges on the photoconductor and those on the tip of the magnetic brush is larger than magnetic attraction force between the toner and the magnetic roll 9 so that the toner is removed from the magnetic roll 9 to adhere to the photoconductor 1. The removal of the toner layer 14 on the first areas 12 and the adhesion of a toner layer 15 on the second areas 13 can be carried out consecutively in the same operation in such a manner.

In the embodiment stated above, the gap length between the cylindrical shell and the surface of the photoconductor is preferably adjusted to 0.3 mm to 1.5 mm. The magnetic toner 5 on the magnetic roll 9 may be controlled to an appropriate thickness by a doctor blade (not shown) disposed adjacent the magnetic roll 9. In case the depth of the toner on the roll is too thin comparatively to the gap length, the toner approaching the charge on the photoconductor is not subject to an electrostatic force of the charge on it. For example, the thickness of about 0.5 mm goes properly with the gap length of about 0.7 mm.

Alternatively, the tips of the toner brush formed on the magnetic roll may slightly rub the surface of the photoconductor 1 to develop the latent image on it and to remove the preformed toner layer 14.

Figure 4:
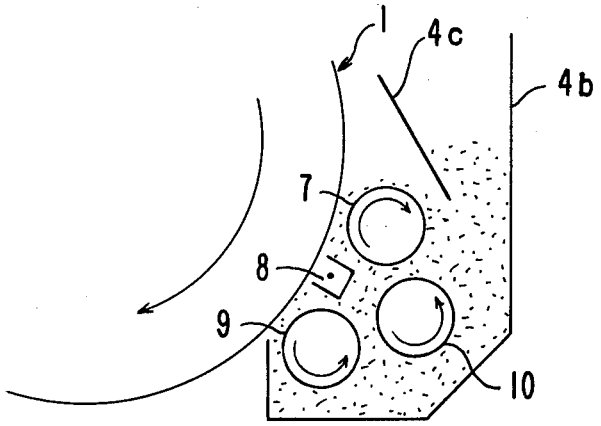
FIG. 4 is a schematic sectional view of an embodiment of a second developing apparatus for carrying out the process of the present invention.

According to the present invention, an apparatus as shown schematically in FIG. 4, is suitable for a reversal development. A photoconductive layer 1 is formed on a cylindrical drum made of, for example, aluminum which rotates clockwise. A first applicator 7 and a second applicator 9 are disposed in a toner tank 4*b* and a charger 8 is mediated between the two applicators. The two applicators may be of magnetic rolls, as shown in FIG. 3 juxtaposed to the cylindrical drum. The apparatus may further comprise a magnetic roll 10 in the toner tank 4*b* for mixing toner.

Magnetic toner which has been put into a hopper 4*c* is mixed by a magnetic roll 10 in the toner tank 4*b*. A first latent image formed on a drum type of a photoconductor 1 is developed by the first magnetic roll 7 and the surface of the photoconductor with a toner image is charged by a charger 8. The first toner image is removed and the second areas are developed by the second magnetic roll 9 by the process described above.

The present invention has been described as to a photoconductor as the electrostatic latent image carrier, whereas the present invention can be put into practice by using a dielectric or an insulating sheet in place of the photoconductor in a similar manner.

Although the invention has been described as to the preferred embodiment utilizing inductively chargeable magnetic toner, it should be understood that other kinds of powder developer may be used, according to the present invention.

On a cascade process as applying powdery developer to the photoconductor, it may be suitable to use a developer mixture of non-magnetic toner and non-magnetic carrier particles. The toner has already been triboelectrically charged to an opposite polarity to that of the carrier by the mixing with each other. Having charged the photoconductor to the opposite polarity to the toner, the toner will adhere primarily to the first higher charged area. On the recharging step, the toner layer and the second lesser charged areas on the photoconductor are charged with the opposite polarity to that of the toner. Subsequently, the photoconductor is subjected to cascading the developer mixture to remove the toner layer from the surface by electrostatic attraction between the opposite charged toner layer and the toner mixed with the carrier particles and to adhere the toner in the mixture to the second lesser charged areas.

Also, instead of the inductively chargeable magnetic toner, a highly resistant magnetic toner may be used in a magnetic brush development. In this case, the toner is beforehand charged to an opposite polarity of the first higher charged areas on the first development. And on the second development, the toner is beforehand charged to the opposite polarity of that of the recharging.

The removal of the toner layer 14 may be carried out by other means than a magnetic brush as stated above. The toner layer may be removed, for example, by blowing with an air jet.

EXAMPLE 1

A commercially available zinc oxide-coated sheet was charged uniformly by a corona charger with an impressed voltage of −6.5 kV to get a uniform negative charge with a voltage of −600 V to ground, and then exposed to a light pattern to produce an electrostatic latent image. The resultant latent image had a maximum voltage of −550 V and a minimum voltage of −50 V. The maximum and the minimum voltage areas corresponded to non-exposed portions and light-exposed portions, respectively.

The latent image was developed by an inductively chargeable magnetic toner having a specific resistance of $10^{11}$ ohm-cm and particle size ranging from 10 to 30 microns through a developing machine having a non-magnetic shell of aluminum having an outer diameter of 31 mm with an inner rotating magnet causing a flux density of 800 G to appear on the shell to produce the normal toner image, the gap between the shell and the sheet being fixed at 0.5 mm. The normal toner image was recharged and redeveloped through a similar charger and developing machine to those in the first normal development to produce the clear reversal image. The reversal image was put on a commercially available sheet and transferred by corona transference at −6.5 kV to produce a usable reversal copy.

EXAMPLE 2

A non-crystalline selenium drum was used as a photoconductor. The selenium was charged to a uniform positive charge with a voltage to ground of +1200 V by a corona charger with an impressed voltage of +7 kV and then exposed to a light image to produce an electrostatic latent image which comprised maximum voltage areas of +1050 V, corresponding to non-exposed portions, minimum voltage areas of +200 V, corresponding to exposed portion, and intermediate voltage areas corresponding to half tone portions. The latent image was then developed in the same manner as used in Example 1 except by using a binary developer mixture of non-magnetic toner and resin-coated iron beads. The developed image was recharged to a uniform positive charge and redeveloped through the same charger and developing machine by rotation of the selenium drum. The finally developed toner image was transferred to paper and fixed on it. The image density on the original minimum voltage areas was 1.35 and that on the original maximum voltage areas was 0.08.

As further embodiments of the present invention, it is possible to use other developers for the second development having different properties from those for the first development, for example, by arranging a suitable cleaning means between recharger 8 and redeveloping machine 9 to remove the toner image at the first development prior to the redevelopment.

On the other hand, it is possible to change the development systems in the first and second development such as, for example, cascade system for one development and magnetic brushing system for the other development. The developer is generally black colored, but the colors of developer may be changed in the first and second developments and the toner image at the first development may be fixed on the photoconductor to produce two-colored copies having the color of the picture different from that of the background.

Still further, it is possible to employ the same charger and developing machine in common in the first and second charging and in the first and second development. As stated above, if desired, the present invention can provide a very wide range of applications and can carry out reversal and normal developments with the same toner in the same unit.

What is claimed is:

1. A reversal developing process for developing an electrostatic latent image on a surface, the latent image being in the form of first charged areas and second lesser charged areas in which the potential of the first charged areas is substantially more in absolute value than that of the second charged areas, the potential of the first charged areas being of a given polarity, the process comprising:

forming a first toner brush with inductively chargeable ferromagnetic toner on a first shell by a magnetostatic attraction force caused by a permanent magnet member incorporated within the shell;

subjecting the first toner brush to the electrostatic force of the charged areas for adhering the toner as a layer on the first charged areas of the surface;

charging with a D.C. charger the toner layer adhering to the first areas and recharging the second areas both with a uniform amount of charge of the same polarity as the potential of the first areas;

damping the electrostatic charge on the first charged areas by dark decay and neutralization by the toner layer;

forming a second toner brush with inductively chargeable ferromagnetic toner on a second shell by a magnetostatic attraction force caused by a permanent magnet member incorporated within the shell; and interpositioning the second toner brush and the surface for subjecting the second toner brush to the electrostatic force of the toner layer on the first charged areas and the electrostatic force of the second charged areas for magnetically removing the previously adhered toner and adhering toner on the second recharged areas in a single pass of the second toner brush.

2. A process for developing an electrostatic latent image according to claim 1, in which each of the steps of subjecting the first toner brush and interpositioning the second toner brush includes the step of contacting the surface with the respective toner brush.

3. A process for developing an electrostatic latent image according to claim 2, in which each of the steps of contacting includes the step of rubbing the surface with the respective toner brush.

4. A reversal developing process for developing an electrostatic latent image on a surface, the potential of the latent image being of a given polarity, the process comprising:

forming a first toner brush with inductively chargeable ferromagnetic toner on a first shell by a magnetostatic attraction force;

subjecting the first toner brush to the electrostatic force of the charge on the surface for adhering a toner layer on the surface according to the charge amount of the latent image on the surface;

charging both the toner layer and non-toner areas of the surface by a uniform amount of charge of the same polarity as the potential of the latent image;

damping the electrostatic charge under the toner layer by dark decay and neutralization by the toner layer;

forming a second toner brush with inductively chargeable ferromagnetic toner on a second shell by a magnetostatic attraction force; and interpositioning the second toner brush and the surface for subjecting the second toner brush to the electrostatic force of the charge on the surface to remove magnetically the previously adhered toner from the surface and to adhere the toner in the second toner brush on the surface according to the charge amount on the surface in a single pass of the second toner brush.

* * * * *